US009938993B2

(12) United States Patent
Roberts

(10) Patent No.: US 9,938,993 B2
(45) Date of Patent: Apr. 10, 2018

(54) HIGH PRESSURE INTENSIFIERS

(75) Inventor: Timothy James Roberts, Bristol (GB)

(73) Assignee: GE Oil & Gas UK Limited, Nailsea (GB)

( * ) Notice: Subject to any disclaimer, the term of this patent is extended or adjusted under 35 U.S.C. 154(b) by 1223 days.

(21) Appl. No.: 13/883,210

(22) PCT Filed: Oct. 31, 2011

(86) PCT No.: PCT/EP2011/069172

§ 371 (c)(1),
(2), (4) Date: Nov. 19, 2013

(87) PCT Pub. No.: WO2012/059478

PCT Pub. Date: May 10, 2012

(65) Prior Publication Data

US 2014/0072454 A1 Mar. 13, 2014

(30) Foreign Application Priority Data

Nov. 2, 2010 (EP) ..... 10189641.3

(51) Int. Cl.

| | |
|---|---|
| ***F15B 3/00*** | (2006.01) |
| ***F15B 9/03*** | (2006.01) |
| ***F04B 9/105*** | (2006.01) |
| ***F04B 9/115*** | (2006.01) |
| ***F04B 49/06*** | (2006.01) |
| ***E21B 33/035*** | (2006.01) |
| *F04B 9/109* | (2006.01) |

(52) U.S. Cl.

CPC ..... *F15B 3/00* (2013.01); *E21B 33/0355* (2013.01); *F04B 9/1095* (2013.01); *F04B 9/115* (2013.01); *F04B 49/06* (2013.01); *F15B 9/03* (2013.01)

(58) Field of Classification Search

CPC .. F15B 3/00; F15B 9/03; F04B 9/1256; F04B 35/045; E21B 33/0355

USPC ..... 417/397

See application file for complete search history.

(56) References Cited

U.S. PATENT DOCUMENTS 2,508,298 A * 5/1950 Saari ..... F01L 25/066 417/225
2008/0223206 A1 9/2008 Igarashi
2009/0317267 A1* 12/2009 Gill ..... F15B 3/00 417/53

FOREIGN PATENT DOCUMENTS

| | | | |
|---|---|---|---|
| CA | 2431620 | A1 | 12/2004 |
| CN | 201339616 | Y | 11/2009 |
| CN | 201547038 | U | 8/2010 |
| CN | 201621112 | U | 11/2010 |

(Continued)

OTHER PUBLICATIONS

Unofficial English translation of Chinese Office Action and Search Report issued in connection with corresponding CN Application No. 201180052978.7 dated Sep. 17, 2014.

(Continued)

*Primary Examiner* — Devon Kramer
*Assistant Examiner* — Lilya Pekarskaya
(74) *Attorney, Agent, or Firm* — GE Global Patent Operation

(57) ABSTRACT

A hydraulic intensifier comprising a reciprocating differential piston arrangement and a controller configured to control the supply of low pressure hydraulic fluid to the intensifier is provided. The controller comprises at least one solenoid operated pilot valve and electronic operator configured to operate the pilot valve.

6 Claims, 2 Drawing Sheets

(56) References Cited

FOREIGN PATENT DOCUMENTS

| | | | | | |
|---|---|---|---|---|---|
| EP | 0654330 | A1 | | 5/1995 | |
| EP | 1138872 | A1 | | 10/2001 | |
| FR | 1414350 | A | * | 10/1965 | ..... F15B 3/00 |
| GB | 1450473 | A | | 9/1976 | |
| GB | 2198081 | A | | 6/1988 | |
| GB | 2275969 | A | | 9/1994 | |
| GB | 2461061 | A | | 12/2009 | |

OTHER PUBLICATIONS

European Search Report dated Apr. 5, 2011 which was issued in connection with EP Patent Application No. 10189641.3 which was filed on Nov. 2, 2010.

International Search Report dated Jan. 17, 2012 which was issued in connection with PCT Patent Application No. EP11/069172 which was filed on Oct. 31, 2011.

* cited by examiner

HIGH PRESSURE INTENSIFIERS

CROSS-REFERENCE TO RELATED APPLICATIONS

This is a national stage application under 35 U.S.C. § 371(c) prior-filed, co-pending PCT patent application serial number PCT/EP11/069172, filed on Oct. 31, 2011, which claims priority to EP Application Serial No. 10189641.3, filed Nov. 2, 2010, the disclosure of which is hereby incorporated in their entirety by reference herein.

BACKGROUND OF THE INVENTION

The present invention relates to high pressure intensifiers.

Within the subsea oil industry, subsea trees require few high pressure valve functions. For most wells, often only one high pressure valve, typically the subsea safety valve (SSSV), is required on each well head tree. This valve requires a source of high pressure hydraulic fluid at the seabed. The cost of an additional high pressure line in an umbilical from a surface platform to a well is very expensive, so subsea pressure intensification, local to the well tree, is sometimes used. This is particularly cost-effective when a number of wells are strung out as offsets fed from a primary manifold, especially as the offsets are increasingly further away from the manifold. Where subsea pressure intensification is used, a high pressure accumulator is designed into the system and, since the SSSV is operated extremely infrequently, the intensifier is only required to top up the accumulator.

Current subsea intensifiers are highly engineered, and can be expensive and unreliable. Typically, they are self-governing, twin-acting, intensifiers that rely on a piston reaching the end of its stroke to trigger a change-over valve, to send the piston back in the opposite direction. When the high pressure fluid demand is almost zero, i.e. when the SSSV is not being actuated and only fluid leakage is 'consuming' pressure, the piston can stall at the end of the stroke with the change-over valve in a half-moved position. In this condition, these devices leak from a low pressure supply, to a return. This can compromise the function of the field and the change-over valve concerned can only be unstuck by actuating the SSSV to 'consume' some high pressure fluid. The SSSV is functionally critical to the oil well and can not easily be replaced if it wears out. This invention enables an improvement, which is more reliable, cheaper and more error tolerant in engineering.

GB-A-2 461 061 describes an intensifier using directional control valves (DCVs). Other forms of hydraulic intensifier are described in GB-A-2 275 969, EP-A-0 654 330, GB-A-2 198 081, GB-A-1 450 473 and EP-A-1 138 872.

BRIEF DESCRIPTION OF THE INVENTION

According to an embodiment of the present invention, a hydraulic intensifier comprising a reciprocating differential piston arrangement and a controller configured to control the supply of low pressure hydraulic fluid to the intensifier is provided. In an embodiment, the controller comprises at least one solenoid operated pilot valve and an electronic operator configured to operate the pilot valve.

In an embodiment, the intensifier comprises a piston which has a first face at a low pressure side and a second, opposite face at a high pressure side wherein the first face having a greater surface area than the second face. The intensifier can further comprise an input for supplying low pressure hydraulic fluid to said low pressure side; and an output for high pressure hydraulic fluid from said high pressure side, said control means being arranged for controlling the supply of low pressure hydraulic fluid to the input.

In an embodiment of the present invention, an intensifier comprises first and second pistons, each of which has such a first face at a respective low pressure side and each of which has such a second face, at a respective high pressure side, wherein there is a respective input at each of the low pressure sides. In an embodiment, the output is coupled with each of said high pressure sides, the pistons are joined by a cylindrical member which defines the second face of each of the pistons, and a controller comprises a respective solenoid operated pilot valve for each input. In an embodiment, the controller is operable alternately by an electronic operator. Typically each of said pistons is reciprocable in a respective cylinder.

According to an embodiment of the present invention, a hydraulic intensifier is provided, comprising a first piston which is reciprocable in a first cylinder, a second piston which is reciprocable in a second cylinder, a cylindrical member joins the pistons so that each piston has a first face which has a greater surface area than its second, opposite face as a result of said cylindrical member, the first face of each of the pistons being at a respective low pressure side and the second face of each of the pistons being at a respective high pressure side. The hydraulic intensifier further comprises first and second inputs for supplying low pressure hydraulic fluid to respective ones of the low pressure sides and an output configured to transport high pressure hydraulic fluid from the high pressure sides, first and second solenoid operated pilot valves for controlling the supply of low pressure hydraulic fluid to respective ones of the inputs and an electronic operator for operating the pilot valves are provided. In an embodiment, the pilot valves are configured to supply low pressure hydraulic fluid alternately to the inputs.

In an embodiment of the present invention, a coupler whereby, if low pressure fluid is applied to one of said low pressure sides, such fluid is also applied to the high pressure side of the other of the pistons, is provided.

The coupler could comprise a first passageway, between the low pressure side of such a first piston and the high pressure side of such a second piston, and a second passageway, between the low pressure side of the second piston and the high pressure side of the first piston, each of the passageways being provided with a respective non-return valve for permitting flow from the low pressure side to the high pressure side.

In an embodiment, the electronic operator could be provided by a subsea electronics module of a subsea well control system.

According to an embodiment of the present invention a method of producing high pressure hydraulic fluid is provided, the method comprising providing a hydraulic intensifier comprising a reciprocating differential piston arrangement and controlling the supply of low pressure hydraulic fluid to the intensifier, using at least one solenoid operated pilot valve and electronic operator which operate the pilot valve.

In an embodiment of the present invention, the intensifier comprises a piston which has a first face at a low pressure side and a second, opposite face at a high pressure side, wherein the first face has a greater surface area than the second face. The intensifier may further comprise an input for supplying low pressure hydraulic fluid to the low pressure side and an output configured to supply high pressure hydraulic fluid from the high pressure side, wherein the controller controls the supply of low pressure hydraulic fluid to the input.

In an embodiment of the present invention, the intensifier could include first and second pistons, each of which comprises a first face at a respective low pressure side and a second face, at a respective high pressure side, wherein: a respective input at each of the low pressure sides and the output is coupled with each of the high pressure sides. In an embodiment, the pistons are joined by a cylindrical member which defines the second face of each of the pistons and the controller comprises a respective solenoid operated pilot valve for each input operated alternately by the electronic operator.

Typically, each piston is reciprocable in a respective cylinder.

According to an embodiment of the present invention, a method of producing high pressure hydraulic fluid is provided. The method comprises providing a hydraulic intensifier comprising a first piston which is reciprocable in a first cylinder and a second piston which is reciprocable in a second cylinder. The method further comprises a cylindrical member joining the pistons so that each piston has a first face which has a greater surface area than its second, opposite face as a result of said cylindrical member, the first face of each of the pistons being at a respective low pressure side and the second face of each of the pistons being at a respective high pressure side. The embodiment further comprises first and second inputs for supplying low pressure hydraulic fluid to respective ones of the low pressure sides and an output configured to transport high pressure hydraulic fluid from the high pressure sides wherein, first and second solenoid operated pilot valves control the supply of the low pressure hydraulic fluid to the respective ones of the inputs. The embodiment further comprises an electronic operator configured to operate the pilot valves to supply low pressure hydraulic fluid alternately to the inputs.

In an embodiment, the method could be such that, if low pressure fluid is applied to one of said low pressure sides, a coupler applies such fluid to the high pressure side of the other of the pistons.

In an embodiment, the coupler could comprise a first passageway, between the low pressure side of such a first piston and the high pressure side of such a second piston, and a second passageway, between the low pressure side of the second piston and the high pressure side of the first piston. In an embodiment, each of the passageways may comprise a respective non-return valve for permitting flow from the low pressure side to the high pressure side.

In a method according to an embodiment of the present invention, the electronic operator could be provided by a subsea electronics module of a subsea well control system.

In an embodiment of this invention, a pressure intensifier that uses commercially available pilot valves to operate a double-acting pair of pistons as a pressure intensifier that operates in a manner that eliminates complex and expensive DCVs and does not suffer from the problem of hydraulic fluid leakage experienced with current designs.

DETAILED DESCRIPTION OF EXEMPLARY EMBODIMENTS OF THE INVENTION

Figure 1:
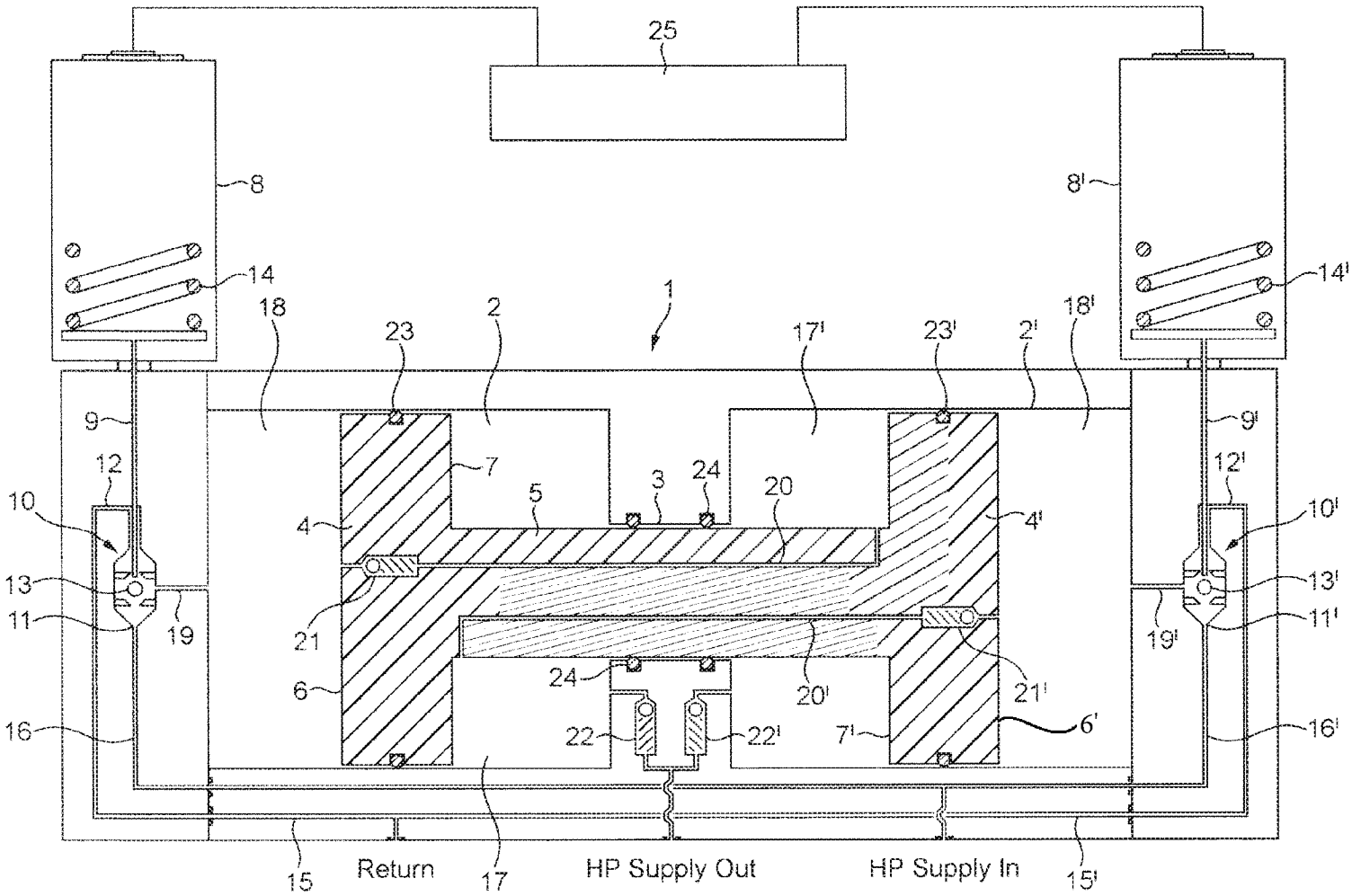
FIG. 1 shows a first embodiment of this invention.

Referring to FIG. 1, a double-acting hydraulic intensifier 1 comprises first and second cylinders 2 and 2' joined by a narrower cylinder section 3. Reciprocally slidable in cylinder 2 is a piston 4 and reciprocally slidable in cylinder 2' is a piston 4', pistons 4 and 4' being joined by a cylindrical member 5 extending through and slidable in cylinder section 3. By virtue of member 5, piston 4 has a first face 6, on the left-hand side in the figure, which has a greater surface area than its second, opposite face 7 and piston 4' has a first face 6', on the right-hand side in the figure, which has a greater surface area than its second, opposite face 7'.

Each side of the intensifier comprises a solenoid operated pilot valve. More particularly, on each side there is: a solenoid 8 or 8' which operates a push rod 9 or 9'; and a hydraulic pilot valve 10 or 10' that has two ports 11 and 12 or 11' and 12' that can be closed by a small ball bearing 13 or 13' that is loose between them. In each case, when the solenoid is de-energised, the rod 9 or 9' presses down on the ball bearing 13 or 13' by the action of a spring 14 or 14' of the solenoid to close the port 11 or 11' but allow trapped hydraulic fluid to vent to a return via port 12 or 12' and a passageway 15 or 15'. When the solenoid 8 or 8' is energised, the rod 9 or 9' is moved upwards against the action of spring 14 or 14' to allow ball bearing 13 or 13' to cover the return port 12 or 12'.

A supply of low pressure (LP) hydraulic fluid is in communication with valves 10 and 10' via passageways 16 and 16' respectively. On the side of pistons 4 and 4' with smaller area faces (the high pressure sides), there are chambers 17 and 17' respectively, on the opposite (low pressure) sides there being chambers 18 and 18'. The valves 10 and 10' are linked with chambers 18 and 18' via input passageway 19 and 19' respectively.

Chamber 18 is in communication with chamber 17' via a passageway 20 through member 3 and a non-return valve 21; and chamber 18' is in communication with chamber 17 via a passageway 20' through member 3 and a non-return valve 21'. Chambers 17 and 17' are in communication with a high pressure (HP) supply output via non-return valves 22 and 22' respectively.

Reference numerals 23 and 23' denote seals via which pistons 4 and 4' slide in cylinders 2 and 2' respectively and reference numerals 24 denote seals against which member 5 slides in section 3.

Reference numeral 25 denotes electronic operating means for alternately energising and de-energising the solenoids 8 and 8', one after the other. The electronic operator 25 could be provided by a multivibrator module attached to or located close to the intensifier for other than subsea well usage. Alternatively, for example, in the case of use of the intensifier in connection with a subsea well, the function of electronic operator 25 could be provided by a subsea electronics module (SEM) of the well control system.

When the solenoid 8 is energised by electronic operator 25, low pressure hydraulic fluid is 'switched' by the pilot valve 10 into the chamber 18, whereby the pressure of the fluid acts on the face 6 of the piston 4, causing the latter to move to the right in FIG. 1 and force the fluid in the chamber 17, through the non-return valve 22 as a high pressure output. This output is at a higher pressure than the low pressure input because the surface area of the piston face 7 is less than the surface area of the piston face 6. The non-return valve 21 allows fluid transfer into the chamber 17', fluid in chamber 18' passing via passageway 19' and port 11' of pilot valve 10' to be vented to the return since solenoid 8' is de-energised. It is to be noted that, because of passageway 20 and non-return valve 21, when low pressure hydraulic fluid is applied to face 6 of piston 4, the pressure of that fluid will also be present at the face 7' of piston 4', thereby increasing the sum of areas exposed to low pressure fluid. Thereafter, de-energising of solenoid 8 and energising of solenoid 8' by electronic operator 25 causes the piston 4 to return to the left, with the same form of pumping action as described above to the high pressure output via valve 22' being effected as a result of the action of piston 4'. Thus, the arrangement of pistons 4 and 4' is double-acting, providing a continuous pumping action.

Figure 2:
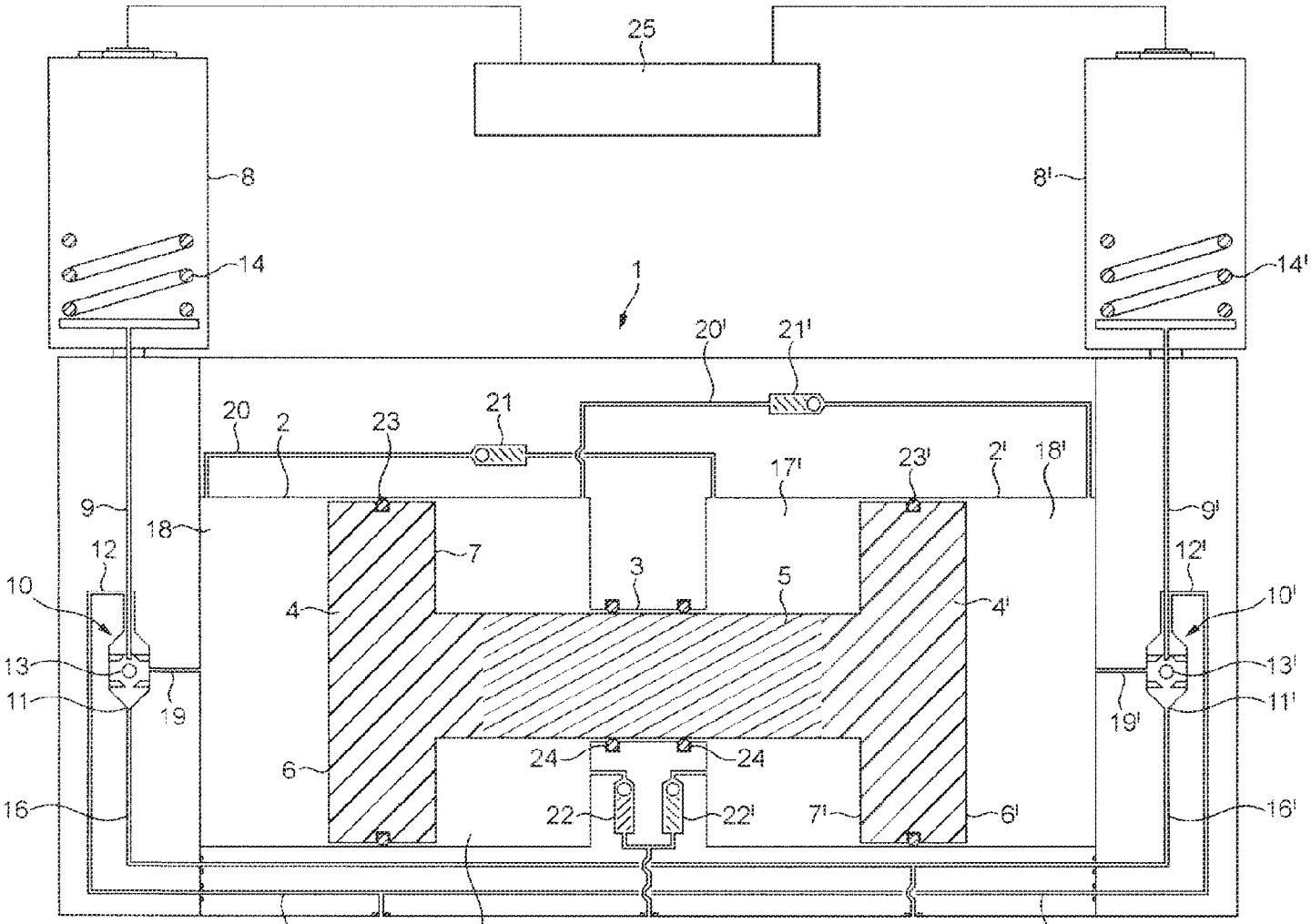
FIG. 2 shows a second embodiment of this invention.

FIG. 2 shows an alternative form of intensifier to that of FIG. 1 in that, for the sake of ease of manufacture, passageway 20 and valve 21 and passageway 20' and valve 21' are external of pistons 4 and 4' and cylinder member 3. Otherwise, its arrangement and manner of operation are identical to the intensifier of FIG. 1.

Advantages of embodiments of the present invention include the pressure intensifier of this invention being more reliable, cheaper to manufacture and does not have the fluid leakage problems of current designs.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A hydraulic intensifier comprising:

a first piston reciprocable in a first cylinder;

a second piston reciprocable in a second cylinder;

a cylindrical member configured to join the pistons so that each piston has a first face which has a greater surface area than its second, opposite face as a result of said cylindrical member, wherein the first face of each of the pistons is located at a respective low pressure side and the second face of each of the pistons is located at a respective high pressure side;

a first input and a second input configured to supply low pressure hydraulic fluid to respective low pressure sides;

an output configured to transport high pressure hydraulic fluid from the high pressure sides;

a first solenoid operated pilot valve and a second solenoid operated pilot valve configured to control the supply of low pressure hydraulic fluid to respective ones of the inputs; and an electronic operator configured to operate the solenoid operated pilot valves configured to supply low pressure hydraulic fluid, wherein the cylindrical member is located between the first and second pistons whereby, if the low pressure fluid is applied to one of said low pressure sides, said low pressure fluid also flows from said low pressure side through the cylindrical member to the high pressure side of the other piston, wherein said cylindrical member comprises a first passageway between the low pressure side of the first piston and the high pressure side of the second piston, and a second passageway between the low pressure side of the second piston and the high pressure side of the first piston, wherein each of the passageways is provided with a respective non-return valve configured to permit flow from the low pressure side to the high pressure side.

2. An intensifier according to claim 1, wherein said electronic operator is provided by a subsea electronics module of a subsea well control system.

3. A method of producing high pressure hydraulic fluid comprising:

providing a hydraulic intensifier comprising:

a first piston reciprocable in a first cylinder;

a second piston reciprocable in a second cylinder; and a cylindrical member configured to join the pistons so that each piston has a first face which has a greater surface area than its second, opposite face as a result of said cylindrical member, wherein the first face of each of the pistons is located at a respective low pressure side and the second face of each of the pistons is located at a respective high pressure side, and wherein said cylindrical member comprises a first passageway, between the low pressure side of the first piston and the high pressure side of the second piston, and a second passageway, between the low pressure side of the second piston and the high pressure side of the first piston, each of the passageways being provided with a respective non-return valve configured to permit flow from the low pressure side to the high pressure side;

supplying low pressure hydraulic fluid to respective low pressure sides using a first input and a second input;

transporting high pressure hydraulic fluid from the high pressure sides using an output;

controlling the supply of said low pressure hydraulic fluid to each input using a first solenoid operated pilot valve and a second solenoid operated pilot valve; and supplying low pressure hydraulic fluid using an electronic operator configured to operate the pilot valves, wherein if low pressure fluid is applied to one of said low pressure sides, said cylindrical member applies fluid to the high pressure side of the other piston.

4. A method according to claim 3, wherein said electronic operator is provided by a subsea electronics module of a subsea well control system.

5. A method according to claim 3, further comprising alternately energizing and de-energizing the first solenoid pilot valve and/or the second solenoid pilot valve using the electronic operator.

6. A method according to claim 3, wherein the output is coupled with each of said high pressure sides.

* * * * *